United States Patent [19]

Overmann

[11] Patent Number: 4,928,832

[45] Date of Patent: May 29, 1990

[54] ADJUSTABLE MERCHANDISE DISPLAY RACK

[75] Inventor: John L. Overmann, Cincinnati, Ohio

[73] Assignee: Hamilton Fixture Company, Ohio

[21] Appl. No.: 262,275

[22] Filed: Oct. 25, 1988

[51] Int. Cl.[5] ..... A47F 5/00

[52] U.S. Cl. ..... 211/187; 211/193; 108/108

[58] Field of Search ..... 211/186, 187, 193, 189, 211/190; 108/108, 96; 403/252, 254

[56] References Cited

U.S. PATENT DOCUMENTS

| | | | |
|---|---|---|---|
| 2,316,892 | 4/1943 | Saul, Jr. | 211/128 X |
| 3,164,260 | 1/1965 | Seemann | 211/189 |
| 3,177,988 | 4/1965 | Costantini et al. | 248/243 X |
| 3,667,826 | 6/1972 | Wood et al. | 211/128 X |
| 3,780,386 | 12/1973 | Fouks et al. | 211/186 X |
| 4,161,303 | 7/1979 | Bachand | 211/193 X |
| 4,460,097 | 7/1984 | Darnell et al. | 211/189 X |
| 4,716,841 | 1/1988 | Suttles | 108/96 X |

FOREIGN PATENT DOCUMENTS

| | | | |
|---|---|---|---|
| 497716 | 9/1954 | Italy | 211/187 |
| 411278 | 11/1966 | Switzerland | 211/187 |
| 1349193 | 3/1974 | United Kingdom | 211/190 |

*Primary Examiner*—Robert W. Gibson, Jr.

[57] ABSTRACT

The present invention is directed to an adjustable merchandise display rack and, more particularly, to a display rack having a base structure, vertical standards extending upwardly at spaced positions along the base structure, and angled legs fixed to the base structure outwardly of the vertical standards at their lower end and which at their upper end are attached to the vertical standards in a manner accommodating some lateral misalignment of the leg with respect to the standard.

4 Claims, 2 Drawing Sheets

ADJUSTABLE MERCHANDISE DISPLAY RACK

FIELD OF THE INVENTION

This invention relates to display racks of the "hook in slot" type, and more particularly to racks of that type in which the merchandise display shelves or bins are mounted to legs which are laterally adjustable.

BACKGROUND OF THE INVENTION

Merchandise racks are used to display a wide variety of consumer products. Typically, such racks have a base structure with a number of parallel vertical standards which extend upwardly from the base. A vertical support panel is generally at the back, and supports the vertical standards. The vertical standards have a series of vertically spaced slots along their height for receiving the "hook" or attachment portion of a merchandise display means such as a shelf unit. Shelf units generally have rigid hook-like projections which are adapted to fit and lock within a slot in two or more of the vertical standards. The vertical standards are fixed to the base in spaced relation so that standard widths of shelving, e.g., four foot or eight foot widths, are supportable thereon.

In a typical display rack, the shelf units are supported such that they extend horizontally or angularly outward from the vertical standards. One drawback of horizontal shelves is that merchandise at the rear of the shelves is less visible than that at the front and therefore tends to sell more slowly; customers cannot see it so easily and it can be overlooked. This problem may be alleviated by supporting the shelves on legs that angle downward and outward from the vertical standards. In this configuration, the shelves are stepped such that each shelf extends further outward from the vertical standards than the shelf above it. Thus, merchandise remaining at the rear of each shelf remains relatively visible.

Merchandise display racks having horizontal shelves can be converted to racks having stepped shelves by adding angled legs to the pre-existing structure to support the stepped shelves. Difficulties arise, however, when there are discrepancies between the horizontal width of the shelving, the spacing of the vertical standards, and/or the spacing between the angled legs. These discrepancies, which are largely due to the manufacturing variances between the different producers of the components of display racks, are very frequent and may be on the order of $\frac{1}{4}''$–$\frac{1}{2}''$ or more. What has been needed is a display rack with angled legs which can accommodate the above-mentioned discrepancies, so as to convert pre-existing merchandise display racks having horizontal shelves, to merchandise display racks having angularly stepped shelves.

SUMMARY OF THE INVENTION

The present invention is directed to an adjustable merchandise display rack which accommodates variances in shelving width, the distances between vertical standards, and the distances between angled legs.

The adjustable merchandise display rack of this invention generally comprises a base structure, a plurality of substantially parallel vertical standards which extend upwardly at spaced positions along the base structure and which have a series of vertically spaced slots along their height for receiving hook means, and a plurality of adjustable angled legs which have a laterally adjustable hook means at their upper ends for attaching the upper end of each leg to a corresponding vertical standard.

Each angled leg is also adapted to be attached at its lower end to the base structure outwardly of the corresponding vertical standard so that the leg slants downwardly and outwardly (from top to bottom) from the vertical standard. Each angled leg has a series of vertically spaced slots along its height, similar to those of the vertical standards, for receiving the attaching hooks of merchandise display means. (As used herein, the term "merchandise display means" is meant to include shelves, bins, gondolas, trays, etc., which are mounted to the legs.)

The adjustable legs have a generally U-shaped transverse cross-section which is defined by two opposite sides connected by a web. The adjustable hook means at the upper end of each leg comprises one or more pins that extend transversely to the leg between the opposite sides of the leg, and a hook that is laterally slidable on the pin between the opposite sides of the leg. The hook, which has an aperture therein through which the pin passes thereby allowing the hook to slide laterally, may be of any suitable configuration which is adapted to engage one of the vertically spaced slots on the vertical standard. In this way, angled legs having laterally adjustable hook means can be affixed to the vertical standards of a pre-existing display rack even when there are discrepancies in the horizontal spacings between the vertical standards, the distances between the angled legs, and the width of the shelf units. The lateral slidability of the hook accommodates variations in these distances, up to the limit of slidability of the hook on the pin.

DETAILED DESCRIPTION OF THE INVENTION

Figure 2:
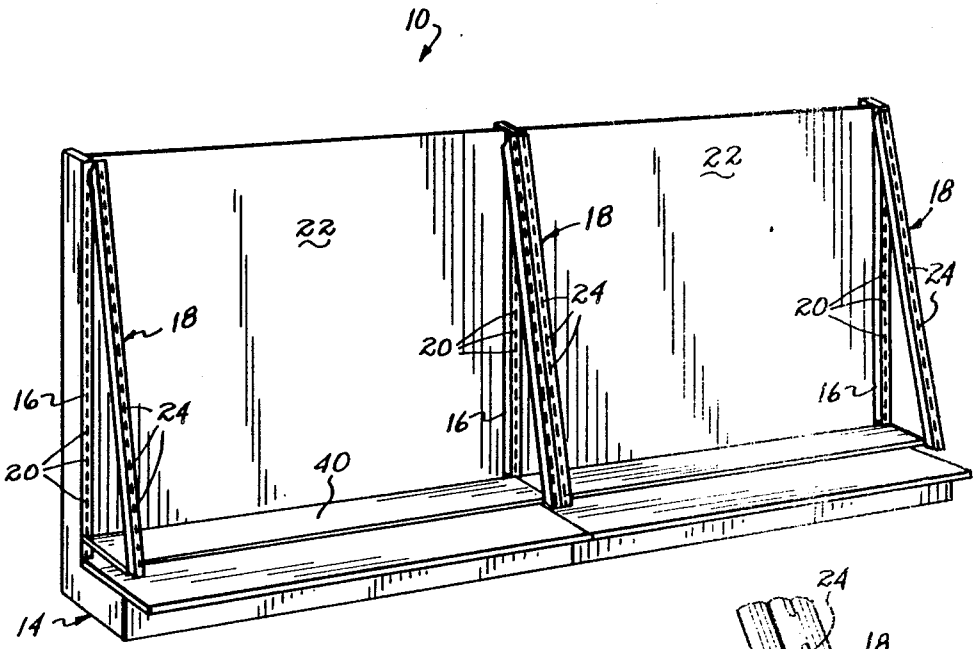
FIG. 2 is a perspective view of the rack, without shelves.
Figure 1:
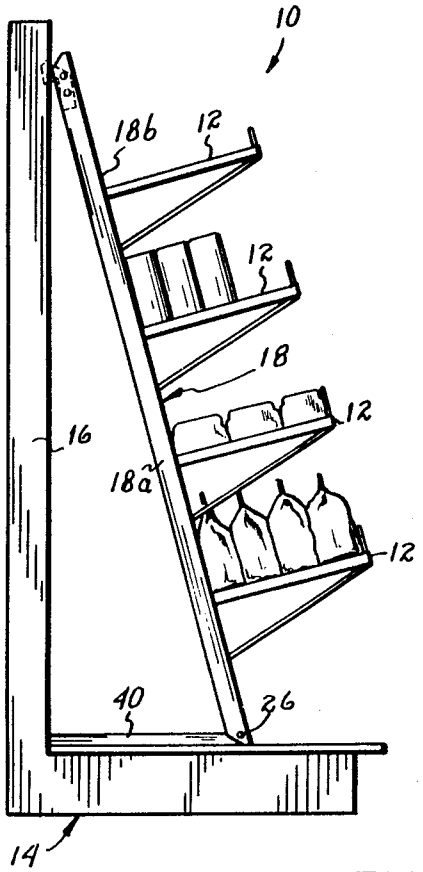
FIG. 1 is a side elevation of an adjustable display rack having merchandise shelves affixed thereto, in accordance with a preferred embodiment of the invention.

A preferred form of the adjustable merchandise display rack 10 of the present invention is shown in FIG. 1 with a plurality of merchandise display shelves 12 in place thereon. As shown in FIGS. 1 and 2, display rack 10 has a base structure 14, a plurality of vertical standards 16, and a plurality of adjustable angled legs 18. Vertical standards 16 are substantially parallel to one another and extend upwardly, in spaced relation, from base 14, to which they are attached at their lower ends. Additionally, vertical standards 16 have a series of vertically spaced slots 20 along their length for receiving hook means. For stability, vertical standards 16 are preferably supported by a back panel 22.

Figure 2A:
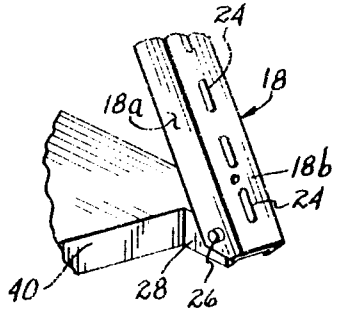
FIG. 2*a* is an enlargement of a portion of FIG. 2.
Figure 3:
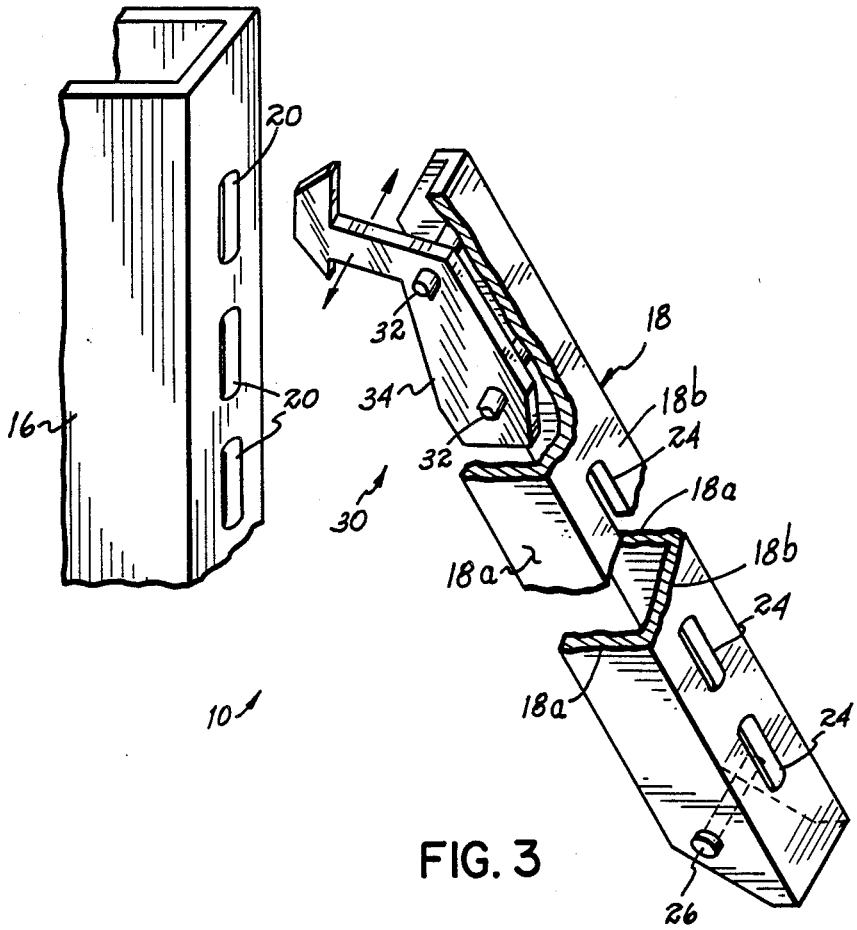
FIG. 3 is an enlarged perspective view, partially broken away, showing how the hook means of the angled leg adjustably interfits with the vertical standard.

Adjustable angled legs 18 have a generally U-shaped transverse cross-section, as can be seen in FIG. 3, which is defined by opposite sides 18*a* connected by web 18*b*. Angled legs 18 also have a series of vertically spaced slots 24 along the length of web 18*b* for receiving the hook means of merchandise display shelves 12. Angled legs 18 are adapted to be attached at their lower ends to base structure 14 outwardly of a corresponding vertical standard 16. FIG. 2*a* shows one embodiment of the means for attaching angled legs 18 to base structure 14; that means comprises a pin 26 which engages projection 28 of spacer 40 which fixes the lower ends of angled legs 18 in spaced relation to the corresponding vertical standards 16.

Angled legs 18 have laterally adjustable hook means at their upper ends for attaching angled legs 18 to corresponding vertical standards 16. The laterally adjustable hook means 30, which is shown in detail in FIG. 3, comprises at least one pin 32 that extends transverse to angled leg 18 and connects opposite sides 18*a*, and a hook 34 that is laterally slidable on pin 32 between opposite sides 18*a* of leg 18. FIG. 3 shows a preferred embodiment of hook means 30; however, it should be appreciated that hook 34 may be of any suitable configuration so long as it is adapted to slide laterally on pins 32 and to engage one of the vertically spaced slots 20 on vertical standard 16. Within the limits of lateral movement between the sides of the leg, the hook thus accommodates lateral misalignment of the leg with respect to the standard. Manufacturing and/or installation variations are typically less than about 1", and the slidability of the hook on its pin will usually accept this so that the leg can be interfitted, at its upper end, with the standard.

Having now described the invention in connection with the particularly illustrated embodiments thereof, it will be appreciated that variations and modifications will occur from time to time to those persons normally skilled in the art without departing from the spirit of the invention, and therefore, the present invention is to be construed in accordance with the appended claims.

What is claimed is:

1. A merchandise display rack comprising:

a base structure;

a plurality of substantially parallel vertical standards, each said vertical standard having an upper and a lower end, said standards affixed at their lower ends to said base structure and extending upwardly at spaced positions along said base structure, each standard having a series of vertically spaced slots for receiving hook means; and a plurality of angled legs, each having an upper end, a lower end opposite sides and having a hook means at its upper end which is laterally slidably adjustable between said opposite sides for attaching said upper end of said leg to a slot o a corresponding vertical standard, each leg adapted to be attached at its lower end to said base structure outwardly of a corresponding vertical standard so that said leg slants downwardly and outwardly from said standard, each leg having along its height a series of vertically spaced slots, similar to those of the standards, to which merchandise display means can be interconnected.

2. The merchandise display rack as recited in claim 1, wherein each said leg has a generally U-shaped transverse cross-section defined by a web and two opposite sides, and said adjustable hook means comprises at least one pin that extends between said opposite sides of said leg and transverse to the height thereof, and a hook that is laterally slidable on said pin between said opposite sides, said hook having an aperture therein through which said pin passes.

3. The merchandise display rack as recited in claim 1 wherein each said angled leg has at least one pin at its lower end that extends between said opposite sides of said leg transverse to the height thereof for engaging said base structure and attaching said leg thereto.

4. A merchandise display rack comprising:

a base structure;

a plurality of substantially parallel vertical standards, each said vertical standard having an upper and a lower end, said standards affixed at their lower ends to said base structure and extending upwardly at spaced positions along said base structure, each standard having a series of vertically spaced slots for receiving hook means; and a plurality of angled legs, each having an upper end and a lower end and having a generally U-shaped transverse cross-section defined by a web and two opposite sides, and having a laterally adjustable hook means at its upper end for attaching said upper end of said leg to a slot of a corresponding vertical standard so that said leg slants downwardly and outwardly from said standard, each leg having along its height a series of vertically spaced slots, similar to those of the standards, to which merchandise display means can be interconnected, said adjustable hook means comprising at least one pin that extends between said opposite sides of said leg and transverse to the height thereof, and a hook that is laterally slidable on said pin between said opposite sides, said hook having an aperture therein through which said pin passes.

* * * * *